US007357118B2

(12) United States Patent
Fujii et al.

(10) Patent No.: US 7,357,118 B2
(45) Date of Patent: Apr. 15, 2008

(54) THROTTLE BODY

(75) Inventors: Takashi Fujii, Shizuoka-ken (JP); Takeshi Nagatsu, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 11/395,347

(22) Filed: Mar. 31, 2006

(65) Prior Publication Data

US 2006/0219219 A1 Oct. 5, 2006

(30) Foreign Application Priority Data

Mar. 31, 2005 (JP) ..... 2005-101274

(51) Int. Cl.
*F02D 11/04* (2006.01)
*F02M 51/00* (2006.01)

(52) U.S. Cl. ..... 123/337; 123/400

(58) Field of Classification Search ..... 123/337, 123/400–401, 73 AD; 251/305
See application file for complete search history.

(56) References Cited

U.S. PATENT DOCUMENTS 5,758,623 A * 6/1998 Nitta et al. ..... 123/470
5,829,409 A * 11/1998 Saito et al. ..... 123/396
6,575,875 B2 * 6/2003 Holmes ..... 477/121
6,832,596 B2 * 12/2004 Watanabe et al. ..... 123/333
6,971,371 B2 * 12/2005 Hotta et al. ..... 123/470
7,028,665 B2 * 4/2006 Taguchi ..... 123/336
7,044,106 B2 * 5/2006 Kojima et al. ..... 123/337
7,093,580 B2 * 8/2006 McLeod ..... 123/376
7,134,425 B2 * 11/2006 Taguchi et al. ..... 123/470
7,159,564 B2 * 1/2007 Yanagii ..... 123/400
7,168,401 B2 * 1/2007 Johnson ..... 123/73 A
7,213,568 B2 * 5/2007 Tweet ..... 123/337
2006/0231070 A1 * 10/2006 Tweet ..... 123/337

FOREIGN PATENT DOCUMENTS

JP 2003-095176 4/2003
JP 2006-283585 * 10/2006

* cited by examiner

*Primary Examiner*—Hai Huynh
(74) *Attorney, Agent, or Firm*—Knobbe, Martens, Olson & Bear, LLP

(57) ABSTRACT

A throttle valve comprises an intake passage. A throttle shaft extends in a generally vertical direction. The lower end of the throttle shaft passes through the throttle valve and projects downward. A throttle lever is connected to the downwardly projecting lower end. The throttle lever is joined to a throttle wire. A fuel injector attachment seat is positioned on one side of the throttle shaft and an intake pressure sensor attachment seat is provided on the other side of the throttle shaft when viewed in the direction along the intake passage.

10 Claims, 13 Drawing Sheets

THROTTLE BODY

CROSS-REFERENCE TO RELATED APPLICATIONS

This application claims the priority benefit of Japanese Patent Application No. 2005-101274, filed Mar. 31, 2005, which is hereby incorporated by reference in its entirety.

BACKGROUND OF THE INVENTION

1. Field of the Invention

The present invention generally relates to a throttle body. More particularly, the present invention relates to a compact throttle body that is configured to reduce infiltration of foreign matter into an intake system of an internal combustion engine.

2. Description of the Related Art

Internal combustion engines generally include an air intake passage through which air is drawn into a combustion chamber. The intake passage typically extends through a throttle body. The amount of air drawn into the engine is controlled by opening and closing the intake passage with a throttle valve.

JP-A-2003-095176 illustrates a throttle body that is used to control the airflow into the associated engine. An intake manifold is positioned beside the throttle body and a fuel injector is mounted to an upper portion of the intake manifold. A main portion of the illustrated throttle body contains an intake passage. A throttle valve is positioned in the intake passage that extends through the throttle body. The throttle valve comprises a throttle plate and a throttle shaft. The throttle shaft extends generally horizontally through the throttle body. An end of the throttle shaft is connected to a throttle lever. An accelerator wire connects to the throttle lever such that axial movement of the accelerator wire causes movement of the throttle lever, which in turn causes rotational movement of the throttle shaft. A bracket is mounted to a side of the throttle body. The accelerator wire extends to the bracket. An intake pressure sensor is positioned on an upper portion of the throttle body. See, for instance, paragraphs 0034-0042 and FIGS. 7 and 8 of the Japanese publication.

The throttle shaft extends horizontally through the throttle body. Therefore, water and dust are likely to work into the throttle body through the hole that receives the throttle shaft. Also, the intake pressure sensor is positioned over the throttle body while the fuel injector is disposed over the intake manifold. In other words, the intake pressure sensor and the fuel injector are disposed generally side-by-side over the intake passage in the axial direction of the intake passage. Therefore, in order to secure sufficient space for both the intake pressure sensor and the fuel injector, the combined axial length of the throttle body and the intake manifold must be somewhat extended. The increased length of the combined throttle body and intake manifold results in the combination occupying more area within any associated engine compartment.

SUMMARY OF THE INVENTION

Therefore, one aspect of the present invention involves providing a throttle body for an intake system, which throttle body reduces the likelihood of infiltration by contaminants, such as dust and water, for example.

Another aspect of the present invention also results in a throttle body that enables the intake system to occupy less space within an associated engine compartment or engine mounting region.

A further aspect of the present invention involves a throttle body that comprises a throttle body housing with an intake passage extending through at least a portion of the throttle body housing. A throttle valve is positioned within the intake passage inside the throttle body housing. The throttle valve comprises a throttle plate supported by a throttle shaft. The throttle plate is moveably positioned within the intake passage. The throttle shaft extends generally vertically within the intake passage. A lower end of the throttle shaft extends through the throttle body housing and an upper end of the throttle shaft does not extend entirely through the throttle body housing. The lower end of the throttle shaft projects down from the throttle body and a throttle lever is attached to the lower end of the throttle shaft.

BRIEF DESCRIPTION OF THE DRAWINGS

These and other features, aspects and advantages of the present invention will be described with reference to drawings of a preferred embodiment. The drawings comprise 13 figures.

DETAILED DESCRIPTION OF THE PREFERRED EMBODIMENT

Figure 7:
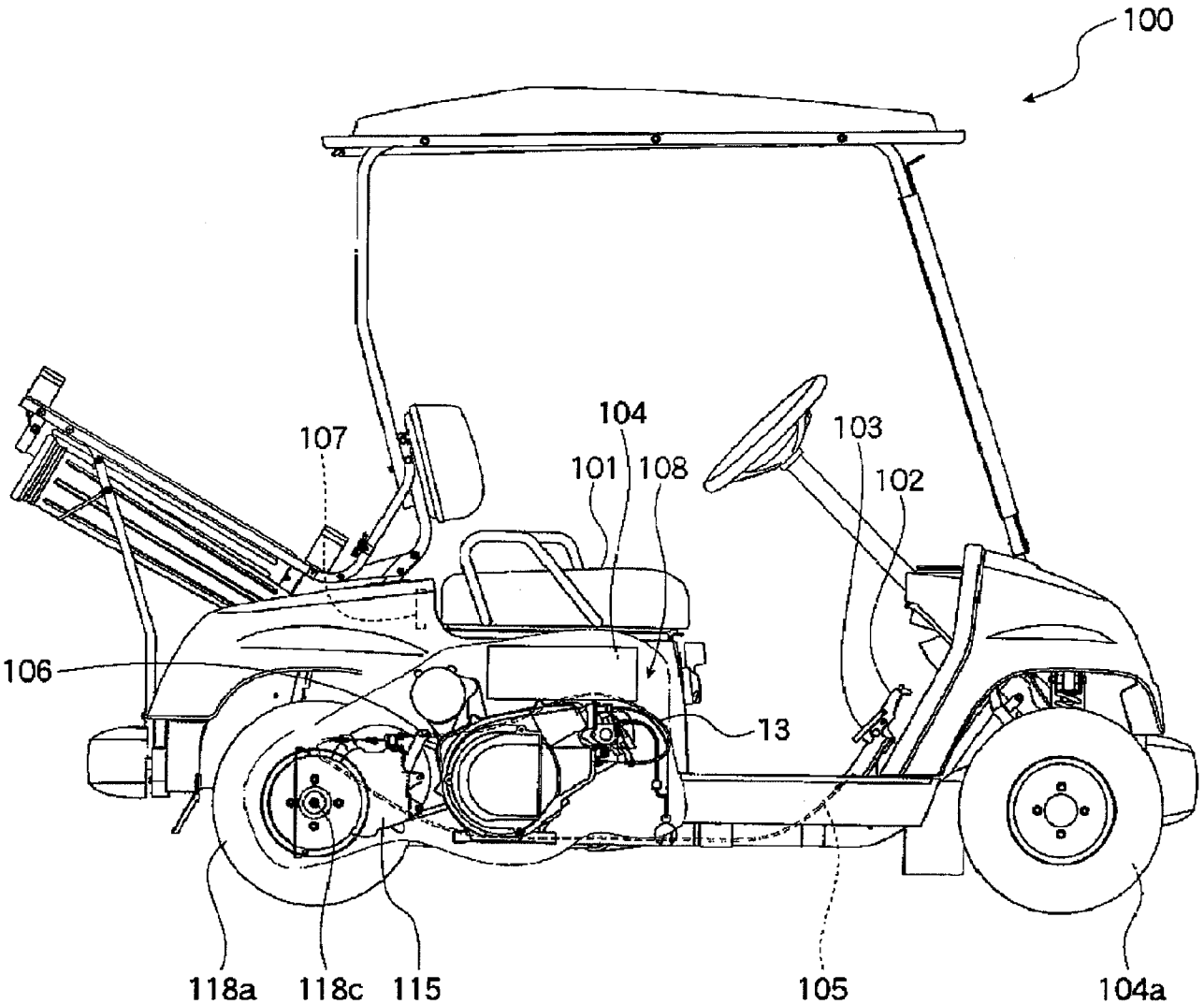
FIG. 7 is a partially sectioned front view of a golf cart that comprises the throttle body of FIG. 1.
Figure 8:
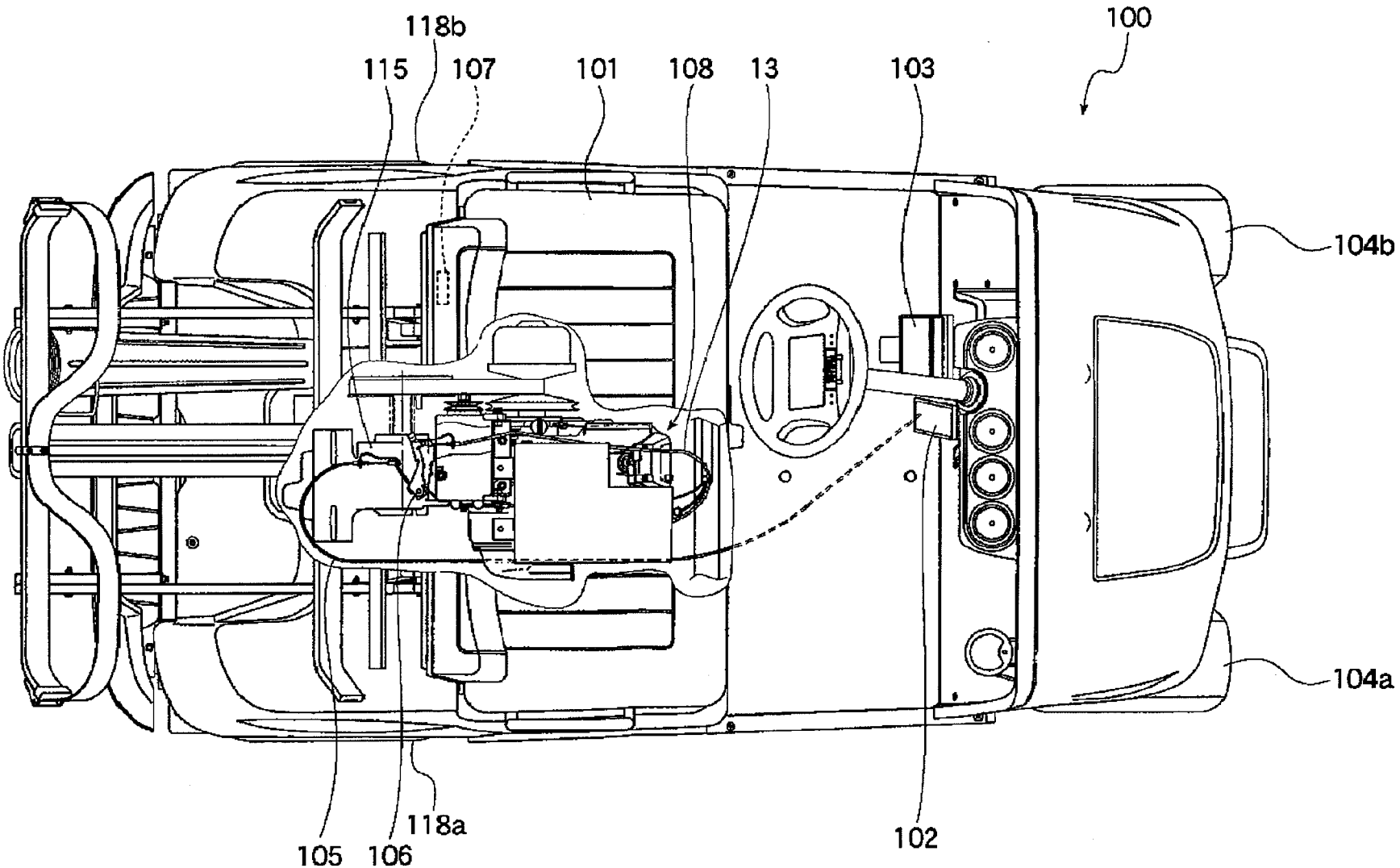
FIG. 8 is a partially sectioned plan view of the golf cart of FIG. 7.

FIGS. 7 and 8 illustrate a golf cart 100 that comprises an engine using a throttle body arranged and configured in accordance with certain features, aspects and advantages of the present invention. While the throttle body is shown in the context of the golf cart 100, the throttle body can be used in other applications. For instance, because of its compact construction, the throttle body can be used in applications such as small land and water vehicles in which the engine compartment is very compact. In some configurations, the throttle body can be used with all terrain vehicles, motorcycles, scooters, small utility vehicles, personal watercraft, snowmobiles and the like.

With continued reference to FIGS. 7 and 8, the golf cart 100 comprises an accelerator pedal 102 and a brake pedal 103. The pedals 102, 103 preferably are of the foot-operated type. The pedals 102, 103 generally are positioned in front of (i.e., to the right in FIGS. 7 and 8) a seat 101. Preferably, the pedals 102, 103 are disposed in about the center of the vehicle body.

The brake pedal 103 can be connected to brake wires (not shown) extending to the brakes of front wheels 104*a* and 104*b*. The accelerator pedal 102 can be connected to one end of an accelerator wire 105 that extends rearward under a main portion of the golf cart 100. The other end of the accelerator wire 105 can be connected to one end of a fitting 106 while the other end of the fitting 106 can be connected to one end of a throttle wire 13.

A controller 107 is provided behind the seat 101. In one preferred embodiment, the controller 107 is an ECU (engine control unit). The ECU 107 can determine the fuel injection rate and the ignition timing of an engine 108, which is mounted under the seat 101 in the illustrated configuration. Other engine positions also are possible. The ECU 107 preferably bases its calculations on information regarding the throttle opening and the air intake rate for the engine. The information can be measured with the accelerator pedal 102, the brake pedal 103, and the intake rate sensor, which will be described in greater detail below.

Figure 9:
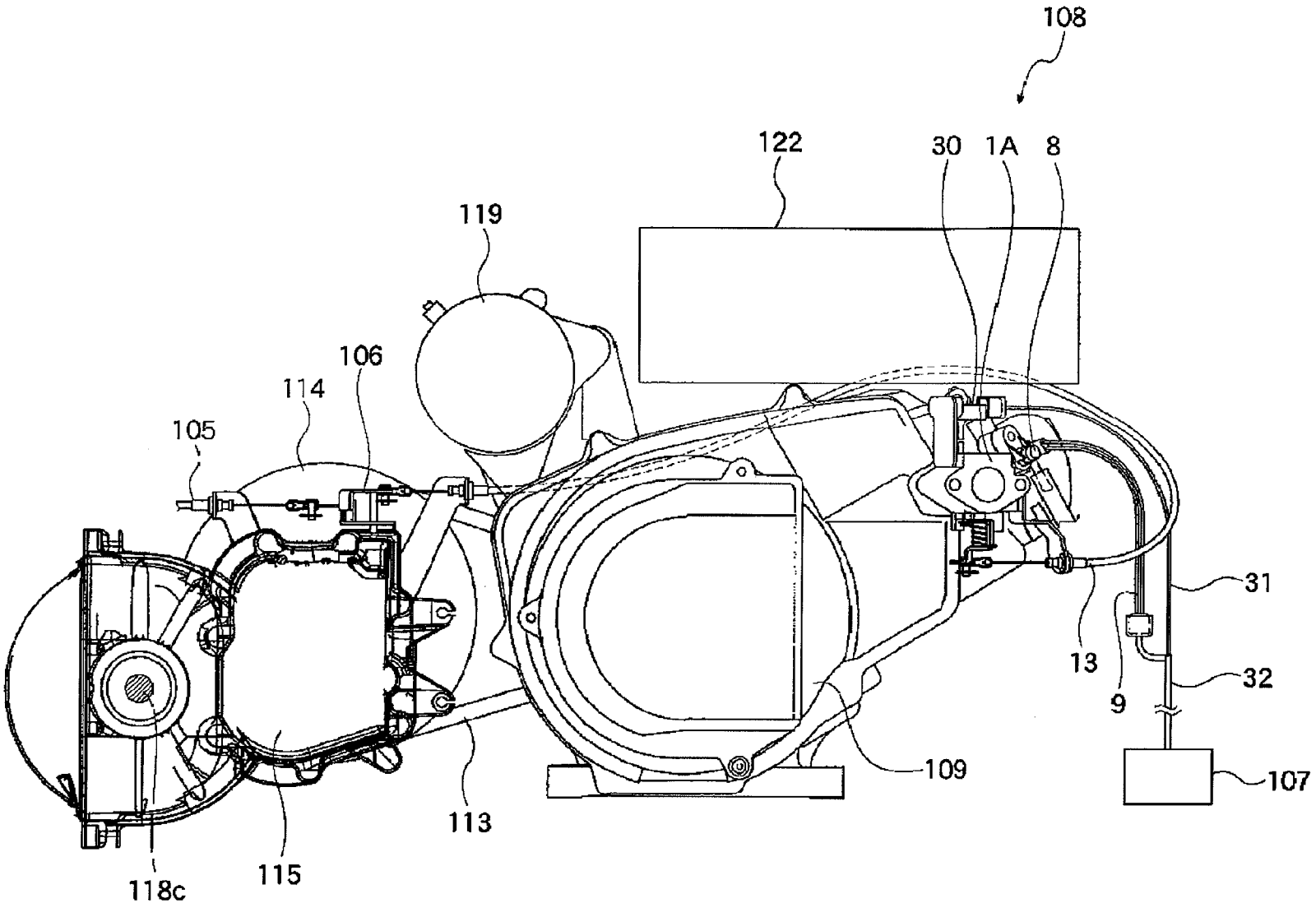
FIG. 9 is a front view of an engine that comprises the throttle body of FIG. 1.
Figure 10:
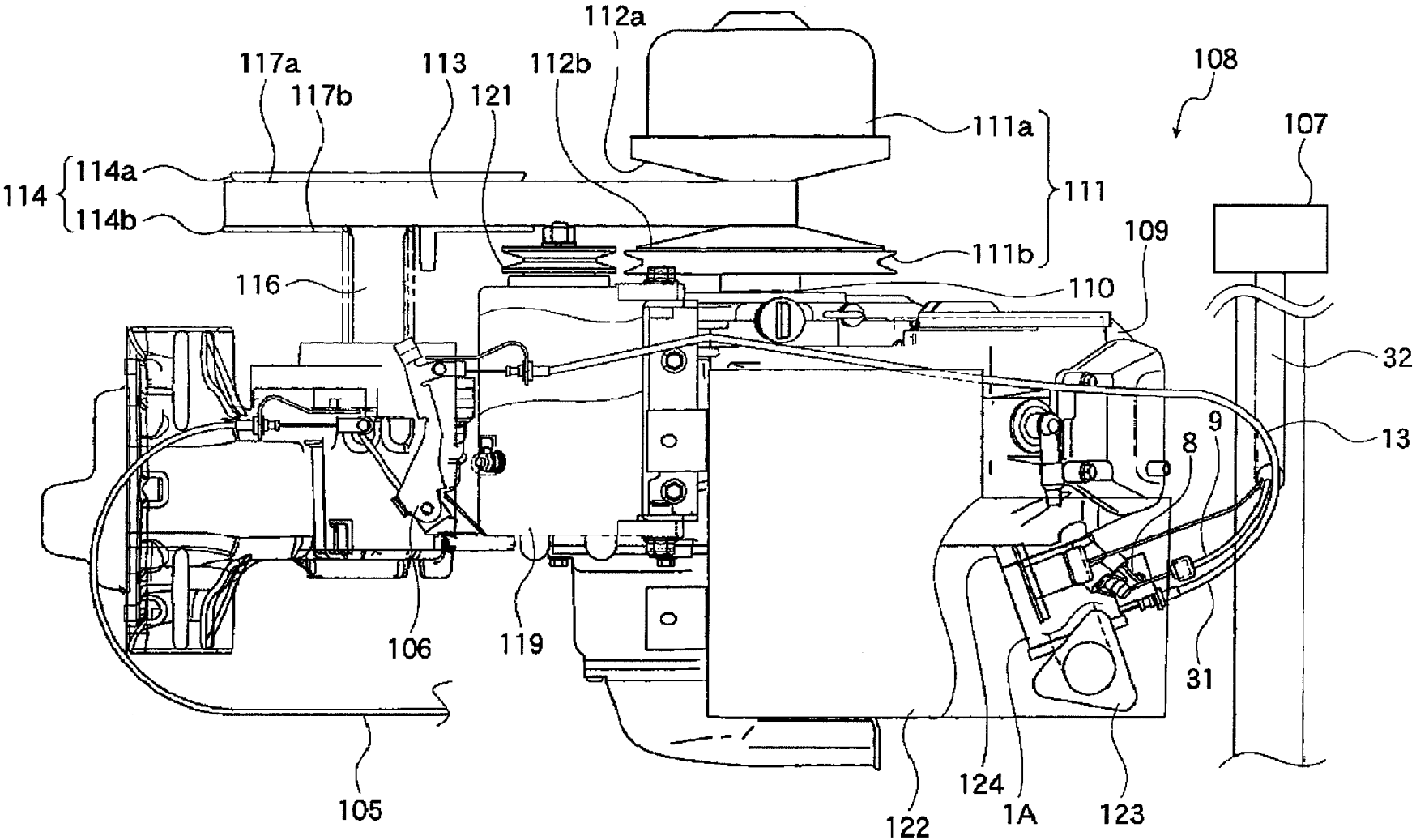
FIG. 10 is a plan view of the engine of FIG. 9.
Figure 11:
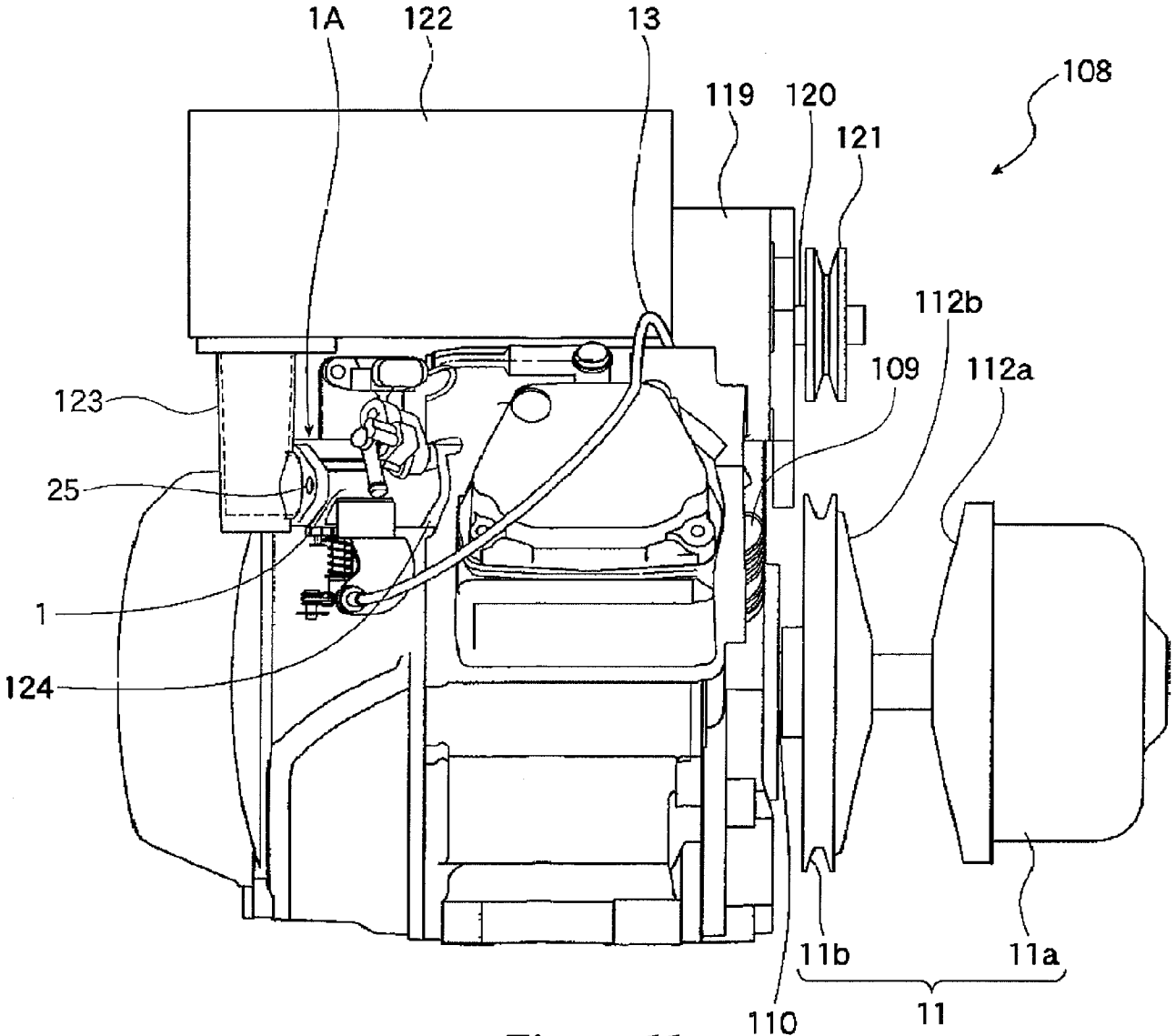
FIG. 11 is a side view of the engine of FIG. 9 with a throttle wire attached to its throttle lever.

With reference now to FIGS. 9 to 11, the engine 108 preferably comprises a cylinder and a piston that are provided in the engine main portion 109. The engine main portion 109 can be an engine block in some configurations. A connecting rod (not shown) transmits the reciprocating motion of the piston to a crankshaft 110. The crankshaft 110 carries a drive pulley 111 at one end. The drive pulley 111 comprises a drive pulley outer member 111*a* and a drive pulley inner member 111*b*. The opposing surfaces of the inner and outer members 111*a*, 111*b* comprise a generally conical configuration, which generally conical portions define belt receiving portions 112*a* and 112*b*, respectively. The drive pulley outer member 111*a* preferably comprises a built-in fan (not shown) that circulates cooling air to the engine block 109. Multiple weights disposed inside the drive pulley inner member 111*b* preferably are axially movable along the axial direction of the crankshaft 110. A V-belt 113 preferably is received in the valley defined between the belt receiving parts 112*a* and 112*b*.

A shaft 116 of a transmission 115 rotatably supports a driven pulley 114. The driven pulley 114 comprises a driven pulley outer member 114*a* and a driven pulley inner member 114*b*. Like the drive pulley 111, the opposite surfaces of the driven pulley outer member 114*a* and the driven pulley inner member 114*b* preferably comprise generally conical shapes to define belt receiving portions 117*a* and 117*b*. The V-belt 113 is received in the valley defined between the belt receiving portions 117*a* and 117*b*. In a preferred configuration, the driven pulley inner member 114*b* is urged sideways with a spring. The driven pulley 114 transmits the driving force of the engine 108 through the transmission 115 to the wheel shaft 118*c* of the rear wheels 118*a* and 118*b* (see FIG. 7). Thus, the drive pulley 111, the driven pulley 114 and the V-belt 113 generally define a continuously variable transmission.

In the illustrated configuration, a starter 119 is provided above a rear portion of the engine block 109. Preferably, the starter 119 comprises, within its cover, a starter motor that is operated by the ECU 107 with electric power supplied from a battery (not shown). The shaft 120 of the illustrated starter 119 carries a starter pulley 121. A starter belt (not shown in FIGS. 8 to 11) extends between the starter pulley 121 and the drive pulley inner member 111*b* of the drive pulley 111. Thus, rotation of the starter pulley 121 can be transmitted to the drive pulley 111.

The engine comprises an air cleaner 122 that filters ambient air drawn through an intake port (not shown) for supply to the engine. The air cleaner 122 is provided above the engine block 109 at a location generally in front of the starter 119. The air cleaner 122 is connected to one end of an air passage member 123.

The air passage member 123 extends to a first end of a throttle body main part 1, which forms a portion of a throttle body 1A that is arranged and configured in accordance with certain features, aspects and advantages of the present invention. A second end of the throttle body main part 1 connects to a first end of an intake manifold 124. A second end of the intake manifold 124 connects to a cylinder head 125 of the engine block 109.

Figure 13:
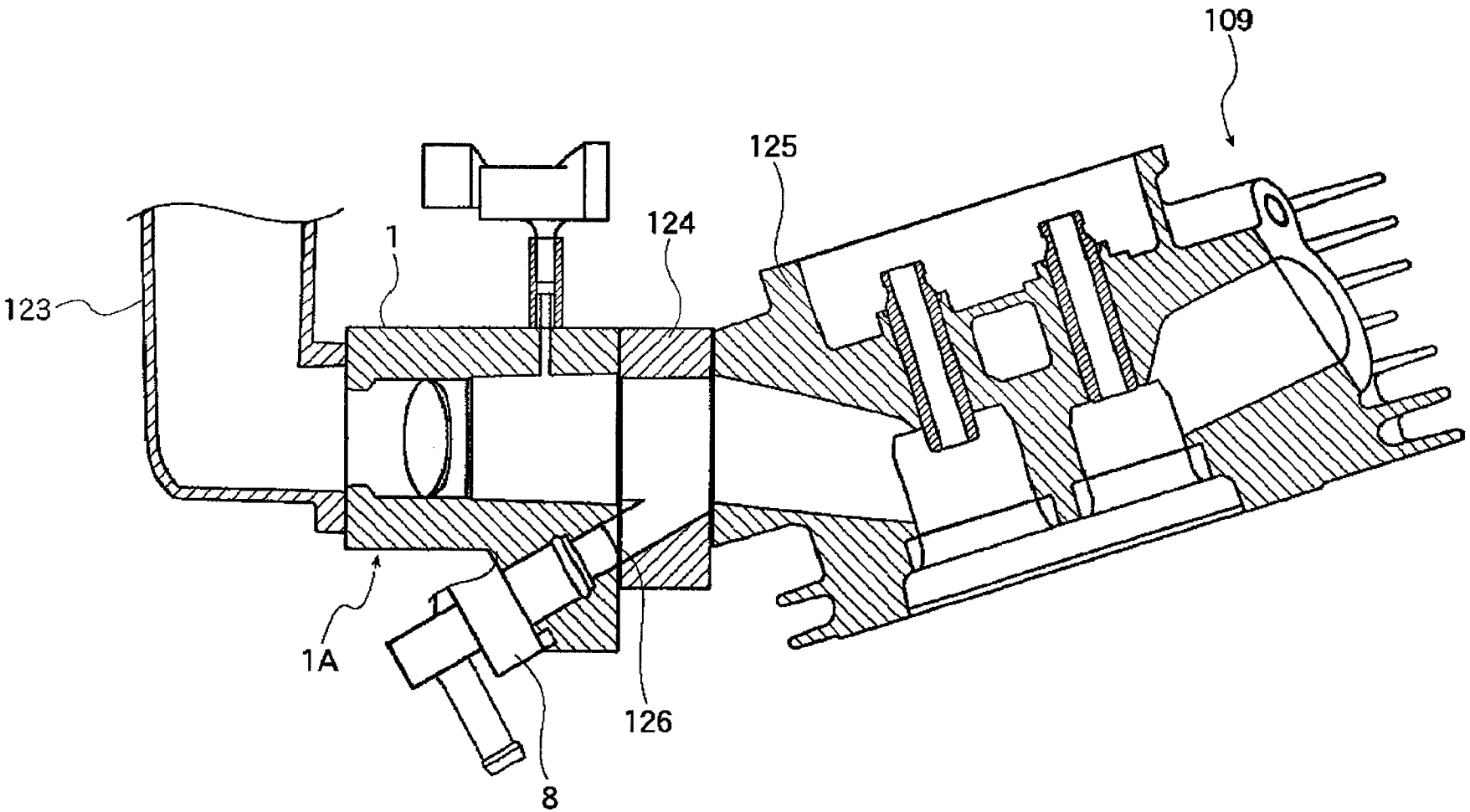
FIG. 13 is a sectioned view of the throttle body region of the engine of FIG. 9.

With reference now to FIG. 13, the air passage member 123 communicating with the air cleaner 122, the throttle body main part 1 (i.e., throttle body housing), and the intake manifold 124, respectively comprise an air passage that extends through each of the components to define an intake system that supplies air through a cylinder head 125 of the engine to a cylinder (not shown).

Figure 1:
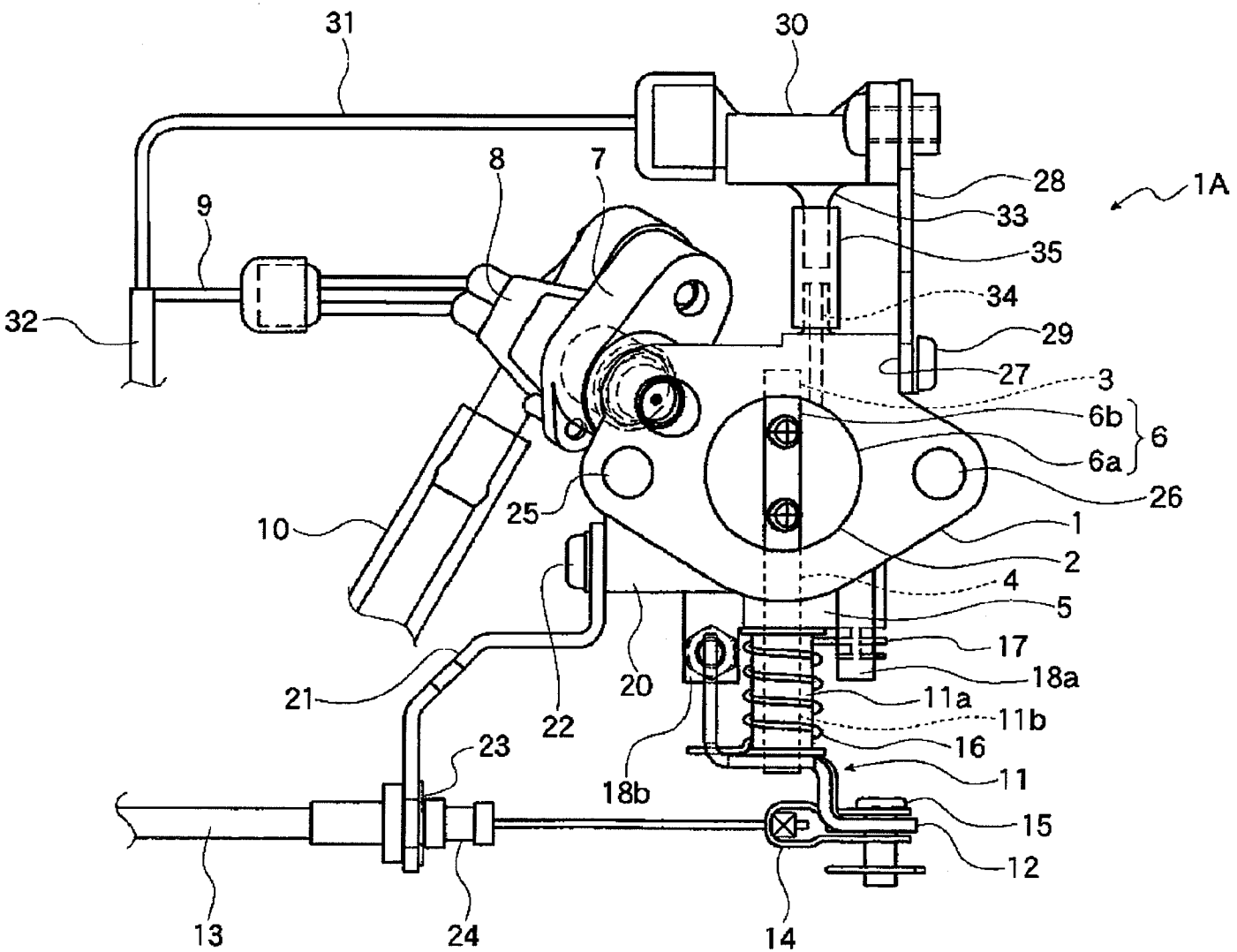
FIG. 1 is a front view of a throttle body arranged and configured in accordance with certain features, aspects and advantages of the present invention.

With reference now to FIG. 1, the throttle body 1A, in particular, the throttle body main part 1 in the illustrated configuration, generally comprises an intake passage 2 and a throttle valve 6. The illustrated throttle body 1A also comprises a fuel injection device 8, an intake pressure sensor 30 and a throttle lever 11 that is adapted to move the throttle valve 6.

Figure 6:
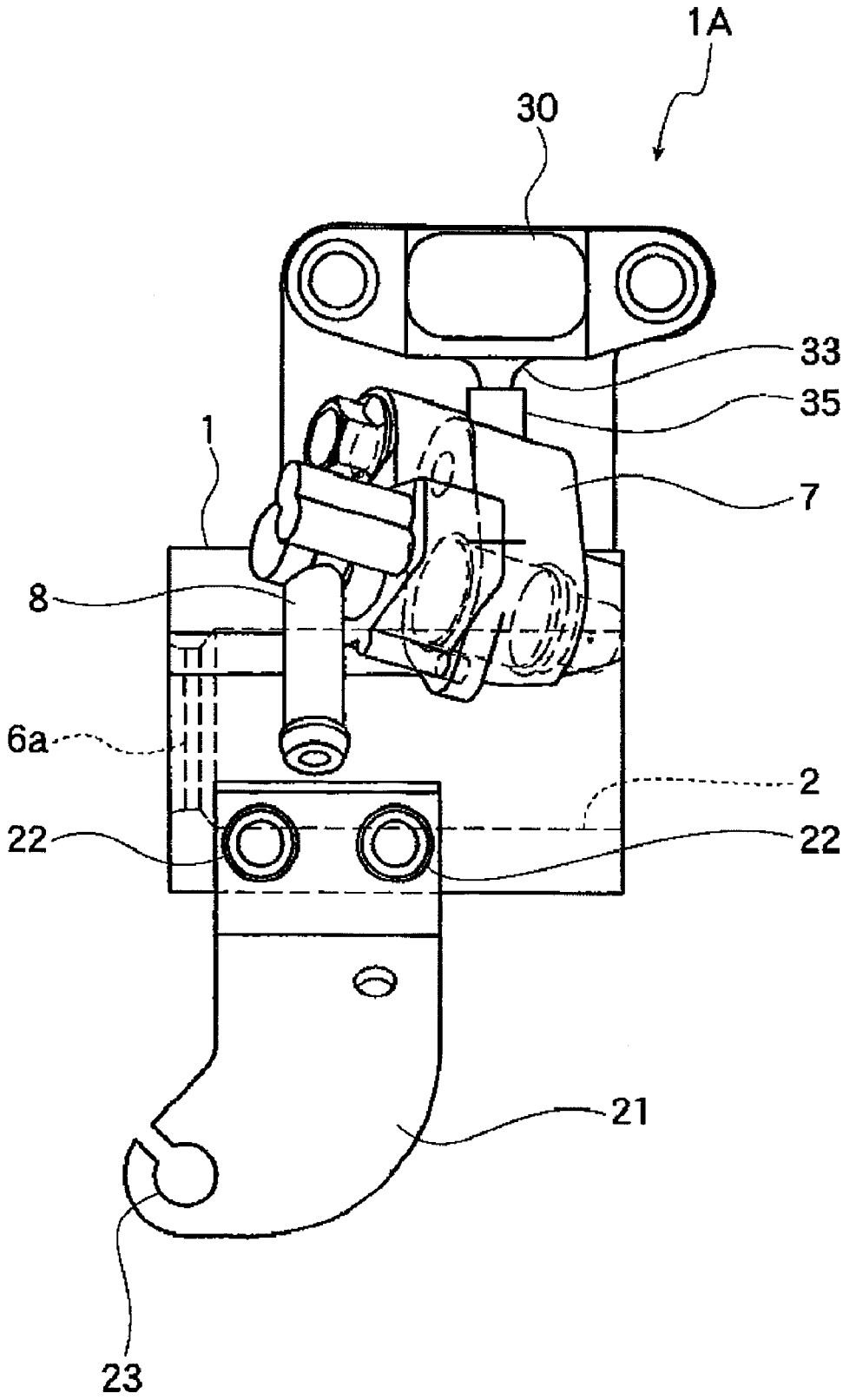
FIG. 6 is a left side view of the throttle body of FIG. 1.

With reference now to FIG. 6, the intake passage 2 extends left to right (i.e., horizontal). The intake passage 2 can be opened and closed with the throttle valve 6. The throttle valve 6 generally comprises a throttle plate 6*a* that is about the same in diameter as one end (e.g., the left end in FIG. 6) of the intake passage 2. A throttle shaft 6*b* supports the throttle plate 6*a*.

Figure 2:
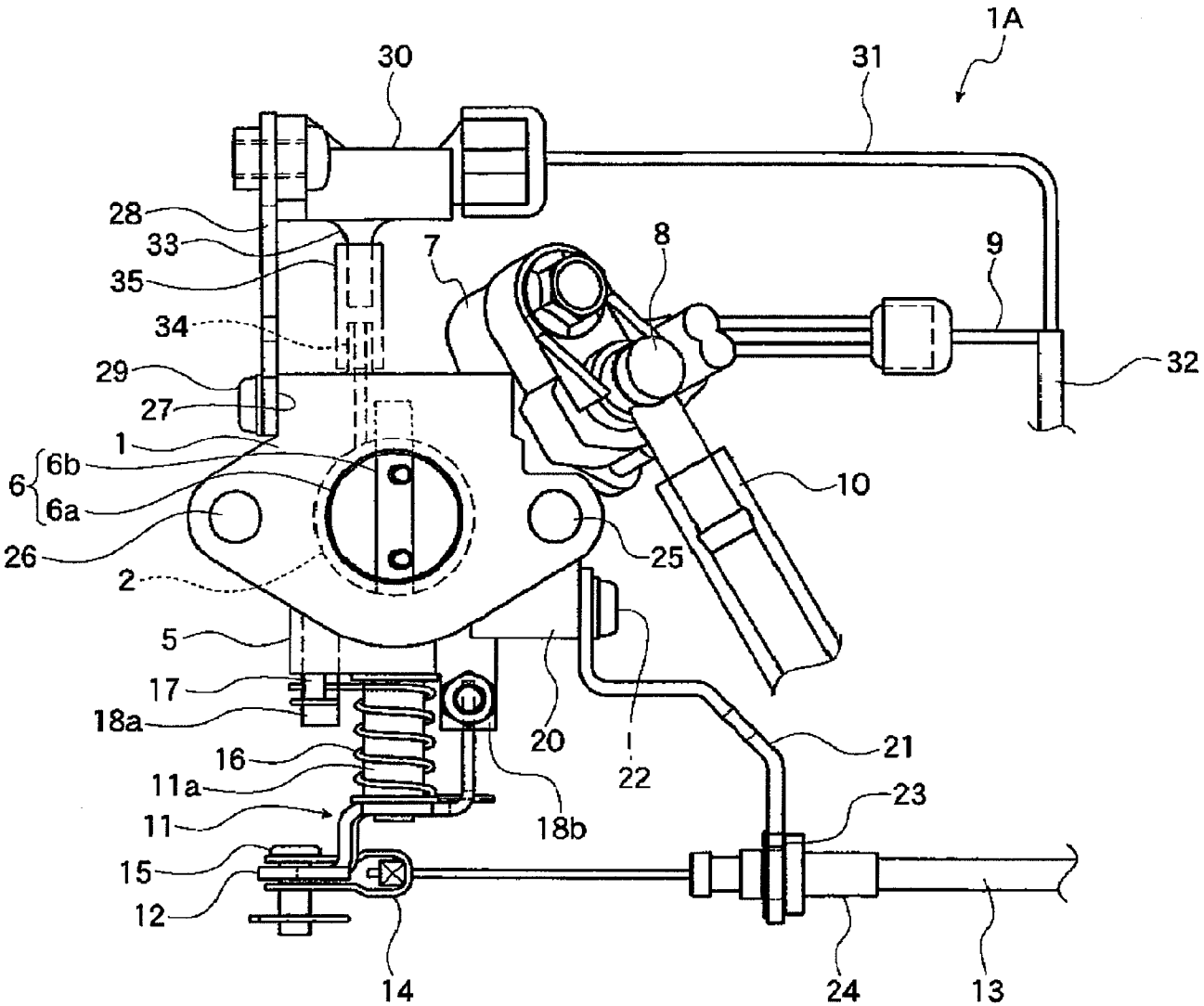
FIG. 2 is a rear view of the throttle body of FIG. 1.
Figure 3:
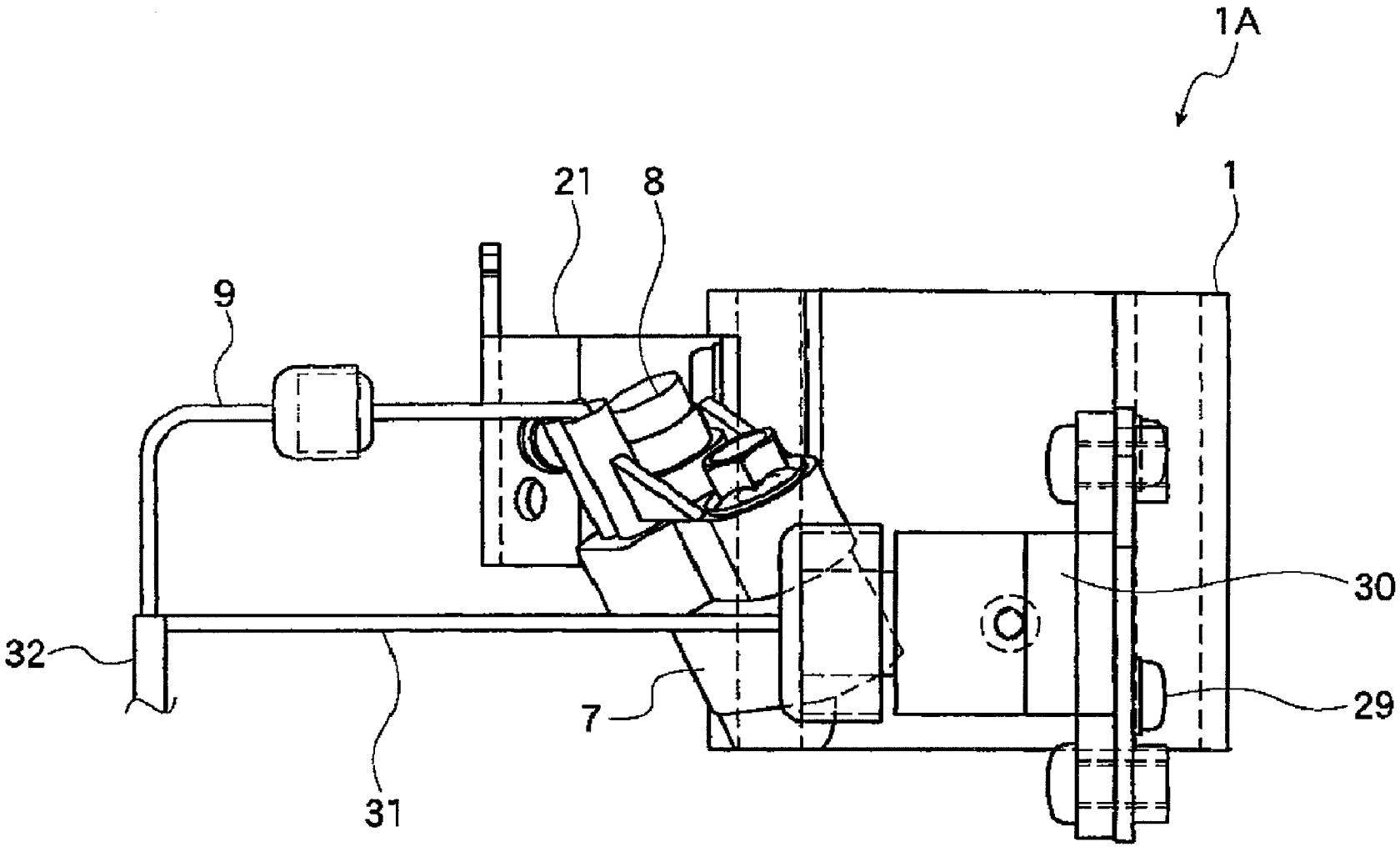
FIG. 3 is a plan view of the throttle body of FIG. 1.

Advantageously, the throttle shaft 6*b* is rotatably mounted such that the throttle plate 6*a* can be moved (i.e., rotated or pivoted) within the passage 2 (see FIGS. 1 and 2). The throttle shaft 6*b* advantageously is disposed generally vertically with its upper end received in a recess 3 or depression formed in the upper side of the illustrated intake passage 2. A lower end of the throttle shaft 6*b* extends through a through hole 4 formed right below the recess 3. Thus, the hole 4 preferably extends from the lower side of the intake passage 2 to the outside of the throttle body main part 1. In other words, the upper end of the throttle shaft 6*b* preferably does not penetrate the passage 2 while the lower end of the throttle shaft penetrates the passage 2. As a result, water and dust are less likely to infiltrate the intake passage 2 through the through hole 4.

As the throttle shaft 6*b* pivots or rotates, the throttle plate 6*a* turns to open, close or alter the size of the opening formed through the intake passage 2. Advantageously, part of the throttle shaft 6*b* near its lower end extends sufficiently downward to a location below a throttle lever contact seat 5. In one preferred embodiment, the through hole 4 extends through the contact seat 5 and the contact seat 5 projects downward from the throttle body main part 1.

The upper portion of the throttle body main portion 1 comprises a fuel injector seat 7 that is positioned on one of the left and right sides (e.g., left side in the configuration of FIG. 1) relative to the throttle shaft 6*b* when the throttle body 1A is viewed in a direction normal to an axis of rotation of the throttle shaft 6*b* (e.g., FIG. 1) and generally along the axial center of the passage 2. Preferably, the fuel injector seat 7 is formed integrally with the throttle body main part 1. In some configurations, however, the fuel injector seat 7 is separately formed and secured in any suitable manner.

A fuel injector 8, or other suitable fuel supply device, can be mounted to the attachment seat 7. The fuel injector 8 preferably comprises a solenoid valve mechanism that is opened or closed based upon electrical signals provided by an electric line 9 that extends from the ECU 107. Other types of fuel supply devices and other types of fuel injectors also can be used. A base end of the illustrated fuel injector 8 preferably connects to a fuel hose 10. The fuel hose 10, in turn, connects to a fuel tank (not shown) and is supplied with pressurized fuel. A fore-end of the fuel injector 8 is directed toward a fuel supply opening 126 formed in the intake manifold 124 (see FIG. 13).

The upper portion of the throttle body main part 1 also comprises an intake pressure sensor attachment seat 27. In one configuration, the intake pressure sensor attachment seat 27 is formed integrally with the throttle body main part 1. In other configurations, the seat 27 can be formed separately and can be secured to the throttle body main part 1 in any suitable manner. Preferably, the intake pressure sensor attachment seat 27 is positioned on an opposite side of the throttle shaft 6*b* relative to the fuel injector seat 7. Again, the position of the intake pressure sensor attachment seat 27 is relative to the axial direction of the intake passage 2. Thus, as shown in FIG. 1, the fuel injector seat 7 can be to the left of the throttle shaft 6 while the intake pressure sensor attachment seat 27 can be to the right of the throttle shaft 6 when viewed in the direction shown in FIG. 1 (i.e., along an axis of the passage 2 and from the downstream end). In one advantageous configuration, the fuel supply opening 126 is downstream of the throttle plate 6A and, when viewed from the fuel supply opening end, the fuel injector seat 7 is to the left and the intake pressure sensor attachment seat 27 is to the right. In one particularly preferred configuration, a plane can be defined by an axis of rotation of the throttle shaft 6*b* and a centerline of the intake passage 2 and the plane can extend between the fuel injection device attachment seat 7 and the intake pressure sensor attachment seat 27. If the fuel injection device attachment seat 7 and the intake pressure sensor attachment seat 27 are integrally formed with the throttle body main part 1, the fuel injector 8 and the intake pressure sensor 30 may be attached directly to the throttle body main part 1 without using extra members, such as brackets or the like. Hence, a simplified construction results.

In the illustrated configuration, the intake pressure sensor attachment seat 27 comprises an attachment end face, which can be configured as a generally vertical surface. An attachment fitting 28 can be secured to the seat 27 and can extend generally vertically from the seat 27. In the illustrated configuration, the attachment fitting 28 can be secured to the seat 28 with a rivet 29. Any other suitable technique can be used to secure the attachment fitting 28 to the seat 27.

Preferably, a first end of an intake pressure sensor 30 can be secured to a corresponding portion (e.g., upper end) of the attachment fitting. In the illustrated configuration, rivets 17 secure the intake pressure sensor 30 to the attachment fitting 28. Advantageously, the intake pressure sensor 30 comprises a suitable mechanism that allows it to measure air pressure.

An air passage pipe member 33 extends generally downward and can be attached generally in the center of the intake pressure sensor 30. The air passage pipe member 33 can be connected to a sensor air passage 34. In the illustrated configuration, a pipe-shaped connecting member 35 connects the air passage pipe member 33 to the sensor air passage 34. In one configuration, the sensor air passage extends upward from the intake passage 2 of the throttle body main part 1. Other configurations are possible.

The intake pressure sensor 30 sends signals to the controller 107 through wiring, an electric line 31, radio waves or the like. In the illustrated configuration, the electric line 31 extends from the intake pressure sensor 30 toward the fuel injection device 8 (e.g., to the left in FIG. 1). The electric line 31 of the intake pressure sensor 30 can be coupled with the electric line 9 of the fuel injector 8 in a wire harness 32 and can extend from the vicinity of the fuel injector 8 to the controller 107 (see FIGS. 9 and 10).

With reference to FIG. 1, the throttle lever 11 can be attached to the lower end of the throttle shaft 6*b*. The illustrated throttle lever 11 has a generally cylindrical shaft member 11*a* with its inside circumferential surface defining a sleeve 11*b* with its inside diameter being about the same as the outside diameter of the throttle shaft 6*b*. The throttle shaft 6*b* is received within the sleeve 11*b*. In other words, the lower part of the throttle shaft 6*b* is inserted into the sleeve 11*b* of the throttle lever 11.

The upper end of the shaft member 11*a* abuts the throttle lever contact seat 5. An elastic member 16 extends around the shaft member 11*a*. In the illustrated configuration, the elastic member 16 is a coil spring, with one end engaging with the throttle lever 11 and with its other end joined to a joining member 17 formed, adjacent to the throttle lever contact seat 5, to project downward from the lower part of the throttle body main part 1. The throttle lever 11 is urged to one direction (clockwise in FIG. 4) by the elastic force of the elastic member 16.

The throttle lever 11 has, below the shaft member 11*a*, plate-shaped turning end parts 12*a* and 12*b* that extend radially outward from the shaft member 11*a*. Both ends of an end member 14 as a plate-made member of a generally U-shape provided at one end of the throttle wire 13, are joined to the turning end parts 12*a* and 12*b* using a rivet 15. Other suitable techniques also can be used.

A bracket attachment seat 20, which is positioned generally below the fuel injection device attachment seat 7, can be provided on the lower portion of the throttle body main part 1. The bracket attachment seat 20 has a generally vertical attachment surface to which the base end portion of a bracket 21 is attached using a rivet 22. As for the bracket 21, its central portion preferably extends generally horizontally, its fore-end bends and extends generally downward, and part of it near its fore-end is provided with a through hole 23. A generally cylindrical wire guide 24 for guiding the throttle wire 13 can be fit into the hole 23. The throttle wire 13 passes through the wire guide 24.

A first bolt hole 25 extends through the lower part of the throttle body main part 1 between the bracket attachment seat 20 and the fuel injection device attachment seat 7 generally parallel to the intake passage 2. A second bolt hole 26 also extends generally parallel to the intake passage 2 in a position opposite the side where the first bolt hole 25 is bored, beyond the throttle shaft 6*b* (e.g., to the right side in FIG. 1), as seen in the direction along the intake passage 2. The inside surfaces of the first and second bolt holes 25 and 26 are provided with threads for engaging with the respective bolts 36 (See FIG. 12). The first and second bolt holes are formed to receive bolts that can be used to secure the throttle body main part 1 to the engine main part 109.

A maximum opening stop 18*a* and a minimal opening stop 18*b* are provided generally below the throttle body main part 1 about the throttle shaft 6*b*. The two stops 18*a*, 18*b* define a range through which the throttle shaft 6*b* can rotate. The maximum opening stop 18*a* projects into the region to contact the turning end member 12 of the throttle lever 11 when the throttle valve 6 rotates to a specified angle in a specified direction (i.e., clockwise in FIG. 4). The minimum opening stop 18*b* projects into the region to contact the turning end member 12 of the throttle lever 11 when the throttle valve 6 rotates to an angle that generally closes the intake passage 2 in a specified direction (i.e., counterclockwise in FIG. 4).

Figure 12:
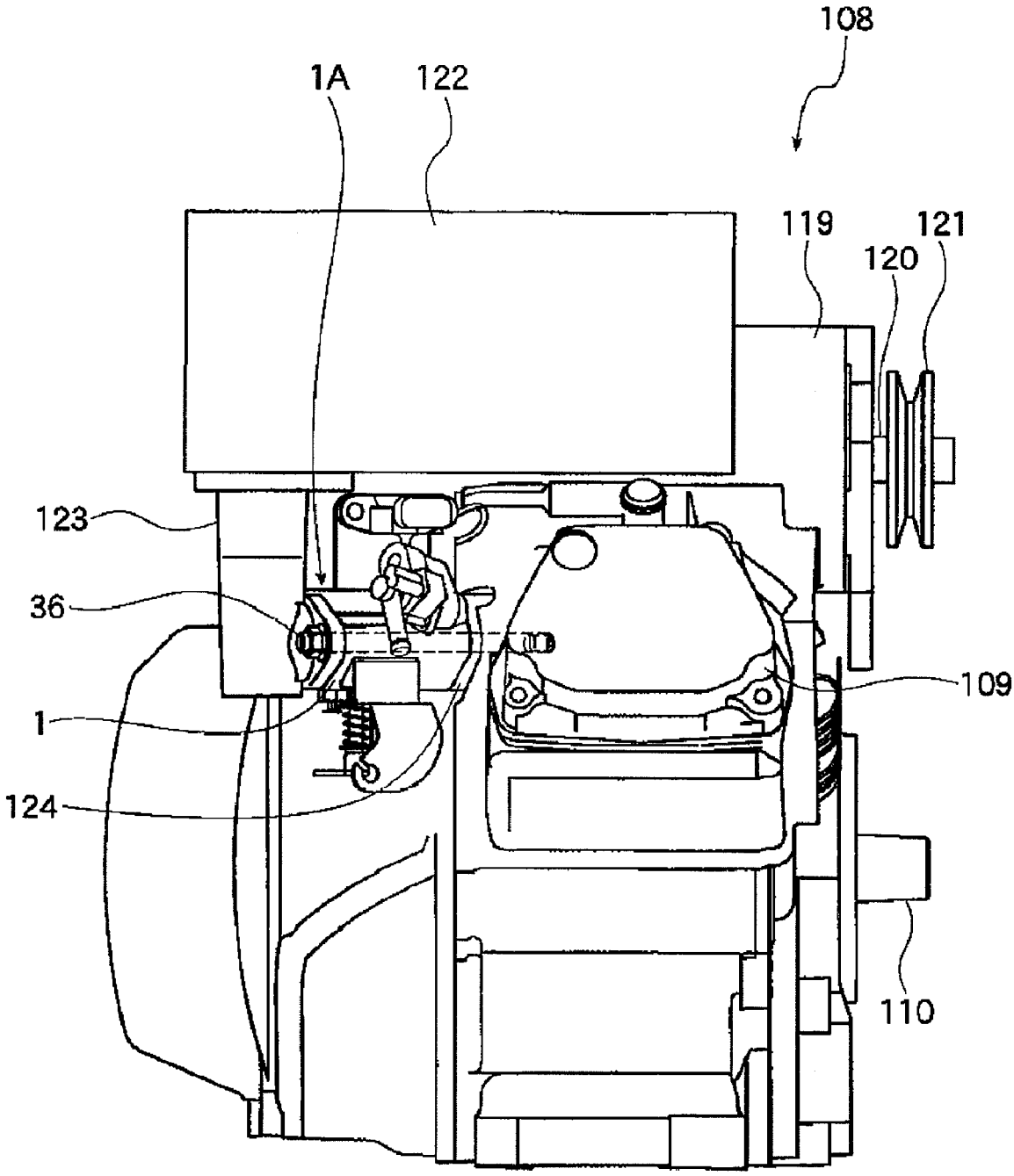
FIG. 12 is a side view the engine of FIG. 9 with a bolt extending through a first bolt insertion hole.

As shown in FIG. 13, one end face of the throttle body main part 1 of the throttle body 1A is connected to one end of the air passage member 123 while the other end face of the throttle body main part 1 is connected to one end of the intake manifold 124. With reference to FIG. 12, bolts 36, 36 can be inserted into the first and second bolt insertion holes 25 and 26, respectively from one end. The bolts 36, 36 are further inserted into bolt insertion holes (not shown) in the intake manifold 104 to let their fore-ends into the throttle body main part 1. In this state, the throttle body main part 1 is joined to the engine main part 109 together with the intake manifold 104 (See FIG. 12).

When an operator sitting on the seat 101 of the golf cart 100 shown in FIGS. 7 and 8 depresses the accelerator pedal 102, the starting motor of the starter 119 (FIG. 9) starts rotating under the control of the controller 107. In the engine 108 shown in FIG. 10, rotation of the starter pulley 121 is transmitted through a starter-use belt (not shown) to the drive pulley inner member 111*b* of the drive pulley 111, and the engine main part 109 starts operation. As the revolution of the crankshaft 110 increases as driven by the engine main part 109, the drive pulley inner member 111*b* moves toward the drive pulley outer member 111*a* due to centrifugal force working on the weights held in the drive pulley inner member 111*b*, and the driven pulley inner member 114*b* of the driven pulley 114 moves away from the driven pulley outer member 114*a* due to tensile force of the V-belt 113. On the contrary, when the revolution of the crankshaft 110 decreases, a phenomenon contrary to the above occurs. In this way, the drive pulley 111 and the driven pulley 114 serve as a continuously variable transmission mechanism using the V-belt 113.

When the operator depresses the accelerator pedal 102, the accelerator wire 105 is pulled toward the accelerator pedal 102 and the connection fitting 106 (see FIG. 9) pulls the throttle wire 13 toward the connection fitting 106. Rotation of the connection fitting 106 is transmitted to the transmission 115 which transmits driving force at a revolution ratio according to the degree of turn of the connection fitting 106 to the rear wheels 118*a* and 118*b*.

As shown in FIG. 1, as the throttle wire 13 is pulled, the throttle lever 11 is also pulled, so that the force applied to the throttle lever 11 gives a turning force to the throttle valve turning shaft 6*b*. If the given turning force exceeds the urging force applied by the elastic member 16, the throttle valve main part 6*a*, that is closing up the intake passage 2, turns in one direction (clockwise in FIG. 4) to open up the intake passage 2. As the intake passage 2 opens, air passing through the air cleaner 122, the air passage member 123, the throttle body 1A, and the intake manifold 124 mixes with fuel sprayed from the fuel injection device 8, and the mixture is supplied into the combustion chamber of the engine main part 109. Air pressure in the intake passage 2 is sensed with the intake pressure sensor 30.

Figure 4:
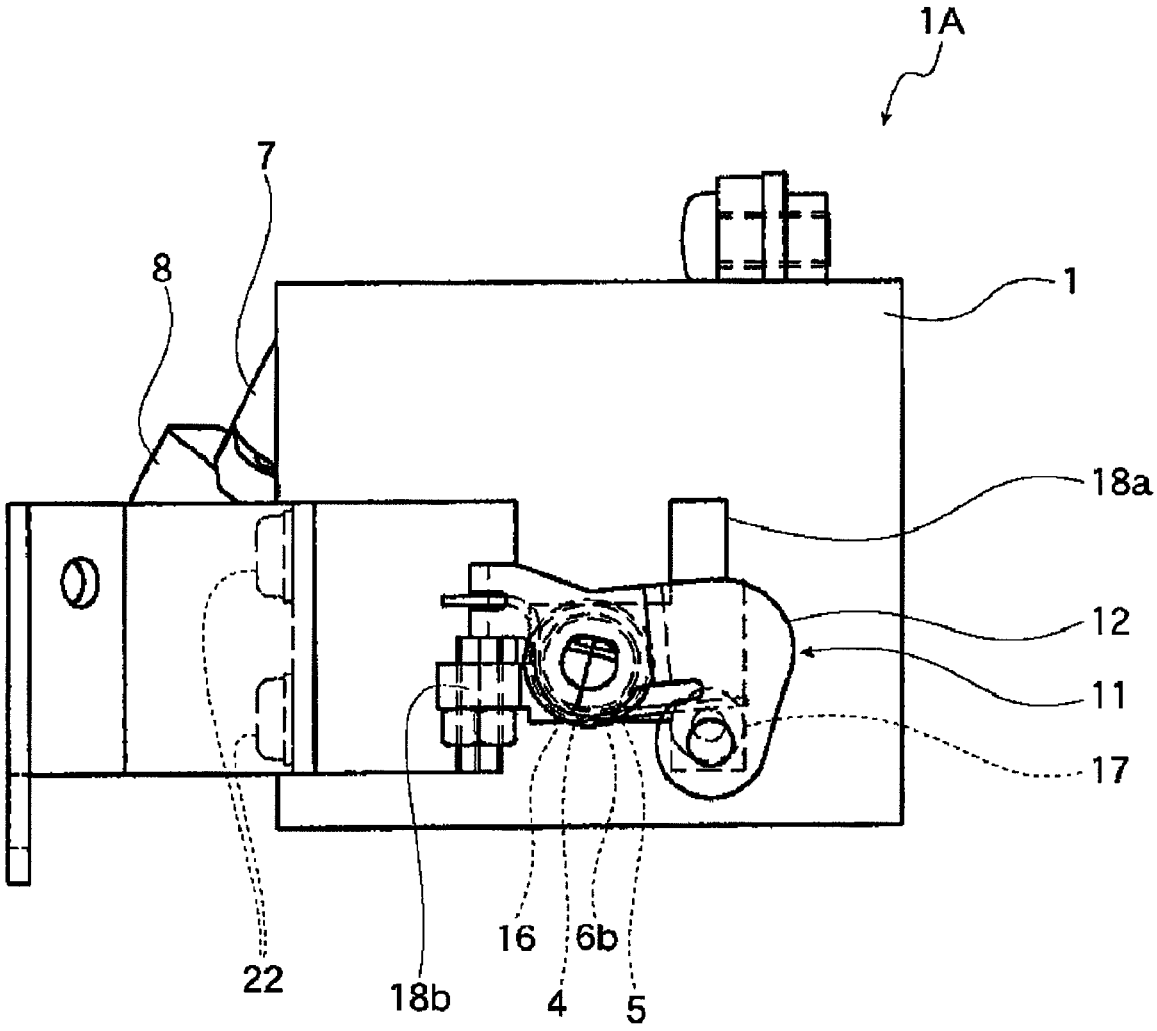
FIG. 4 is a bottom view of the throttle body of FIG. 1.
Figure 5:
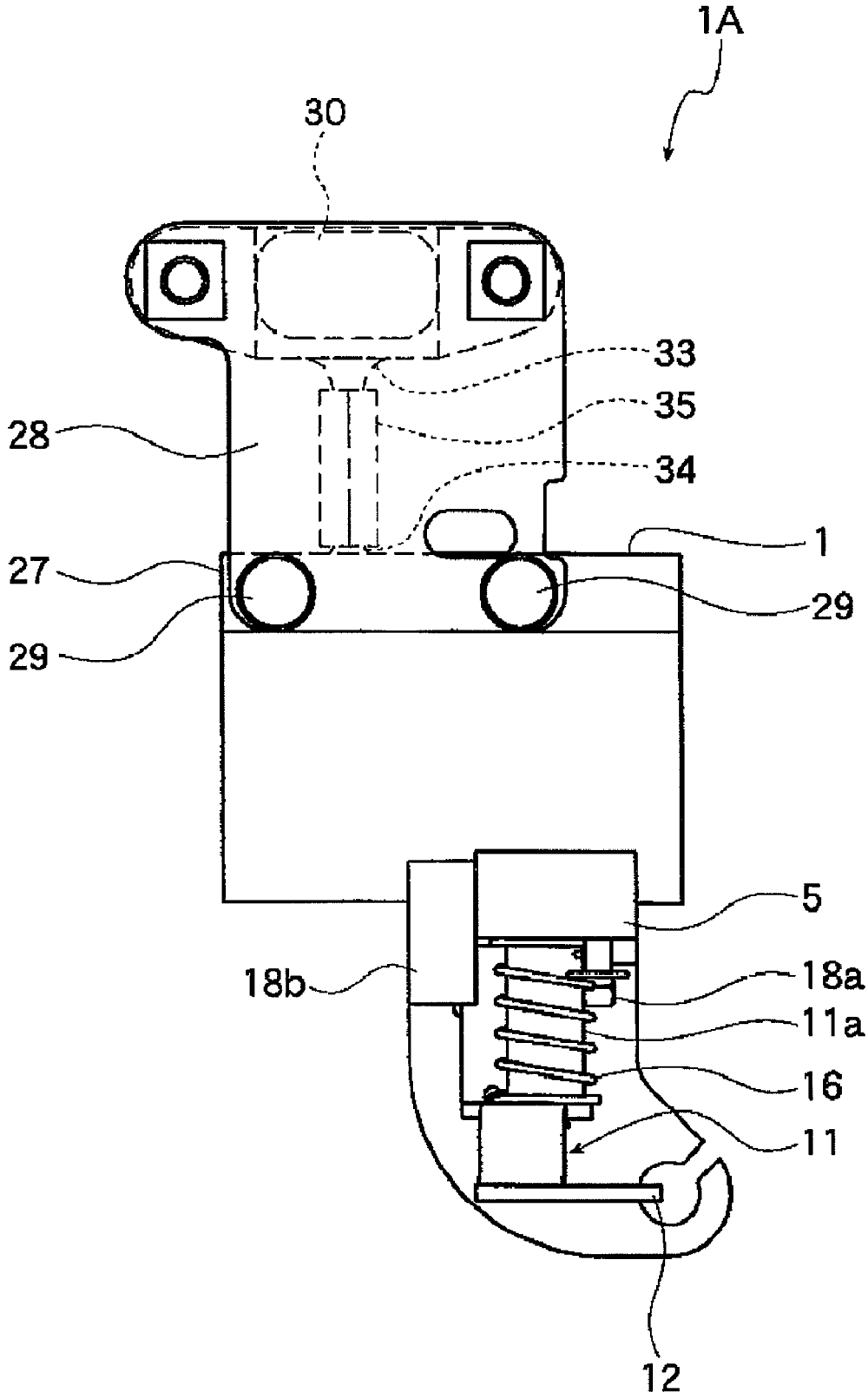
FIG. 5 is a right side view of the throttle body of FIG. 1.

As the accelerator pedal 102 (FIGS. 7 and 8) is depressed by more than a specified displacement to turn the throttle valve turning shaft 6*b* up to a specified angle, as shown in FIG. 4, the maximum opening stop 18*a* of the throttle lever 11 comes into contact with the turning end part 12*a* or 12*b* to prevent the throttle valve 6 from turning beyond the specified angle. This prevents the intake passage 2 from being opened up beyond a specified limit and reduces the likelihood of air being supplied in excess into the engine main part 109.

Information on the throttle opening when the operator depresses the accelerator pedal 102 (FIGS. 7 and 8) and on the intake pressure sensed with the intake pressure sensor 30 is supplied through the electric line 31 to the controller 107 (FIGS. 9 and 10). The controller 107 determines fuel injection rate and ignition timing for the engine 108 on the basis of the information on the throttle opening and the intake pressure. The controller 107, according to the determined fuel injection rate; causes fuel to be sprayed from the fuel injection device 8 and ignited in the combustion chamber of the engine main part 109.

When the operator removes his foot from the accelerator pedal 102 (FIGS. 7 and 8), the accelerator wire 105 is pulled in the direction away from the accelerator pedal 102. Accordingly, as shown in FIG. 1, the force of the throttle wire 13 that is pulling the throttle lever 11 disappears, so that the throttle valve turning shaft 6*b* turns in the other direction (i.e., counterclockwise in FIG. 4) by the urging force of the elastic member 16, the turning end member 12 of the throttle lever 11 comes into contact with the minimum opening stopper 18*b*, so that the throttle valve main part 6*a* substantially fully closes the intake passage 2. Also, by instruction from the controller 107, fuel injection from the fuel injection device 8 to the engine main part 109 is stopped or greatly reduced. For instance, in embodiments where the engine stops when the operator removes his foot from the accelerator, fuel injection can be stopped.

Although this invention has been disclosed in the context of a certain preferred embodiment, it will be understood by those skilled in the art that the present invention extends beyond the specifically disclosed embodiment to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. Thus, it is intended that the scope of the present invention herein disclosed should not be limited by the particular disclosed embodiment described above, but should be determined only by a fair reading of the claims.

What is claimed is:

1. A throttle body comprising a throttle body housing, an intake passage extending through at least a portion of the throttle body housing, a throttle valve being positioned within the intake passage inside the throttle body housing, the throttle valve comprising a throttle plate supported by a throttle shaft, the throttle plate being moveably positioned within the intake passage, the throttle shaft extending generally vertically within the intake passage, a lower end of the throttle shaft extending through the throttle body housing and an upper end of the throttle shaft not extending entirely through the throttle body housing, the lower end of the throttle shaft projecting down from the throttle body housing and a throttle lever being attached to the lower end of the throttle shaft.

2. The throttle body according to claim 1, wherein an upper portion of the throttle body housing comprises a fuel injection device attachment seat and an intake pressure sensor attachment seat, a plane defined by an axis of rotation of the throttle shaft and a centerline of the intake passage, the plane being positioned between the fuel injection device attachment seat and the intake pressure sensor attachment seat.

3. The throttle body according to claim 2 further comprising an intake pressure sensor that is attached to the intake pressure sensor attachment seat and a fuel injector that is attached to the fuel injection device attachment seat, an electrical conductor connected to the intake pressure sensor and the electrical conductor extending toward the fuel injector.

4. The throttle body according to claim 3 further comprising a fuel injector electrical conductor, the fuel injector electrical conductor and the electrical conductor of the intake pressure sensor being coupled together by a single wiring harness.

5. The throttle body according to any one of claim 1 further comprising a first stop and a second stop, the first and second stops being attached to the throttle body housing and defining a limited range of movement for the throttle plate.

6. The throttle body of claim 5, wherein the range of movement is adjustable.

7. The throttle body of claim 1 further comprising a throttle wire that is connected to the throttle lever, the throttle wire extending through a wire guide, the wire guide being supported with a bracket, the bracket mounted to a bracket attachment seat that is provided on the throttle body housing, and a throttle body mounting bolt hole being positioned between the bracket attachment seat and the fuel injection device attachment seat of the throttle body housing.

8. The throttle body of claim 1 wherein a fuel injection device attachment seat is integrally formed with the throttle body housing.

9. The throttle body of claim 1, wherein an intake pressure sensor attachment seat is integrally formed with the throttle body housing.

10. The throttle body of claim 1, wherein the upper end of the throttle shaft is positioned within a recess formed within the intake passage of the throttle body housing.

* * * * *